United States Patent [19]

Krauss

[11] 4,236,852

[45] Dec. 2, 1980

[54] APPARATUS FOR THE LOOSENING AND LIFTING OF AERATED PULVERIZED MATERIAL AT AN INCREASED PRESSURE FROM A SILO

[75] Inventor: Werner Krauss, Hamburg, Fed. Rep. of Germany

[73] Assignee: Claudius Peters Ag.

[21] Appl. No.: 956,800

[22] Filed: Nov. 1, 1978

Related U.S. Application Data

[63] Continuation of Ser. No. 790,961, Apr. 26, 1977, abandoned.

[30] Foreign Application Priority Data

May 6, 1976 [DE] Fed. Rep. of Germany ..... 2619993

[51] Int. Cl.[3] ..... B65G 53/40

[52] U.S. Cl. ..... 406/90; 406/141; 406/156

[58] Field of Search ..... 222/193, 195, 630; 302/53, 57; 406/90, 138, 141, 142, 156

[56] References Cited

U.S. PATENT DOCUMENTS

| | | | |
|---|---|---|---|
| 2,106,869 | 2/1938 | Falkenstein et al. | 302/53 UX |
| 2,509,983 | 5/1950 | Morrow | 302/53 UX |
| 3,265,445 | 8/1966 | Cronin | 222/193 UX |
| 3,905,650 | 9/1975 | Freeman | 302/53 |
| 3,933,394 | 1/1976 | Klein et al. | 302/57 |
| 3,976,232 | 8/1976 | Heidebroek | 222/193 |
| 3,980,208 | 9/1976 | Hehl | 222/193 |
| 3,994,824 | 11/1976 | White et al. | 302/53 X |
| 4,037,877 | 7/1977 | Foster | 302/57 X |

*Primary Examiner*—F. J. Bartuska

*Attorney, Agent, or Firm*—Otto John Munz

[57] ABSTRACT

An upright storage silo for fluid materials, such as comminuted, powdered and granulated livestock feed, flour, grain, spices, sugar, cement, fertilizer and similar, has a mixing chamber centrally located within the silo; a discharge chamber within the silo in communication with the mixing chamber, and defining an area separate from the silo interior; a plurality of aeration orifices within the floor of the silo; a lifting tank in conduit connection with the mixing chamber and discharge chamber; a shut-off mechanism, and a dosage mechanism for conveying the material from the silo. Flow control apparatus of the pressure of aeration is employed for lifting, pulverizing and discharge of the material by utilizing the increased discharge pressure of the pulverized material for the lifting thereof. The material rises under the increased pressure in communication with the silo discharge aperture and thereafter the pressure is relaxed.

3 Claims, 1 Drawing Figure

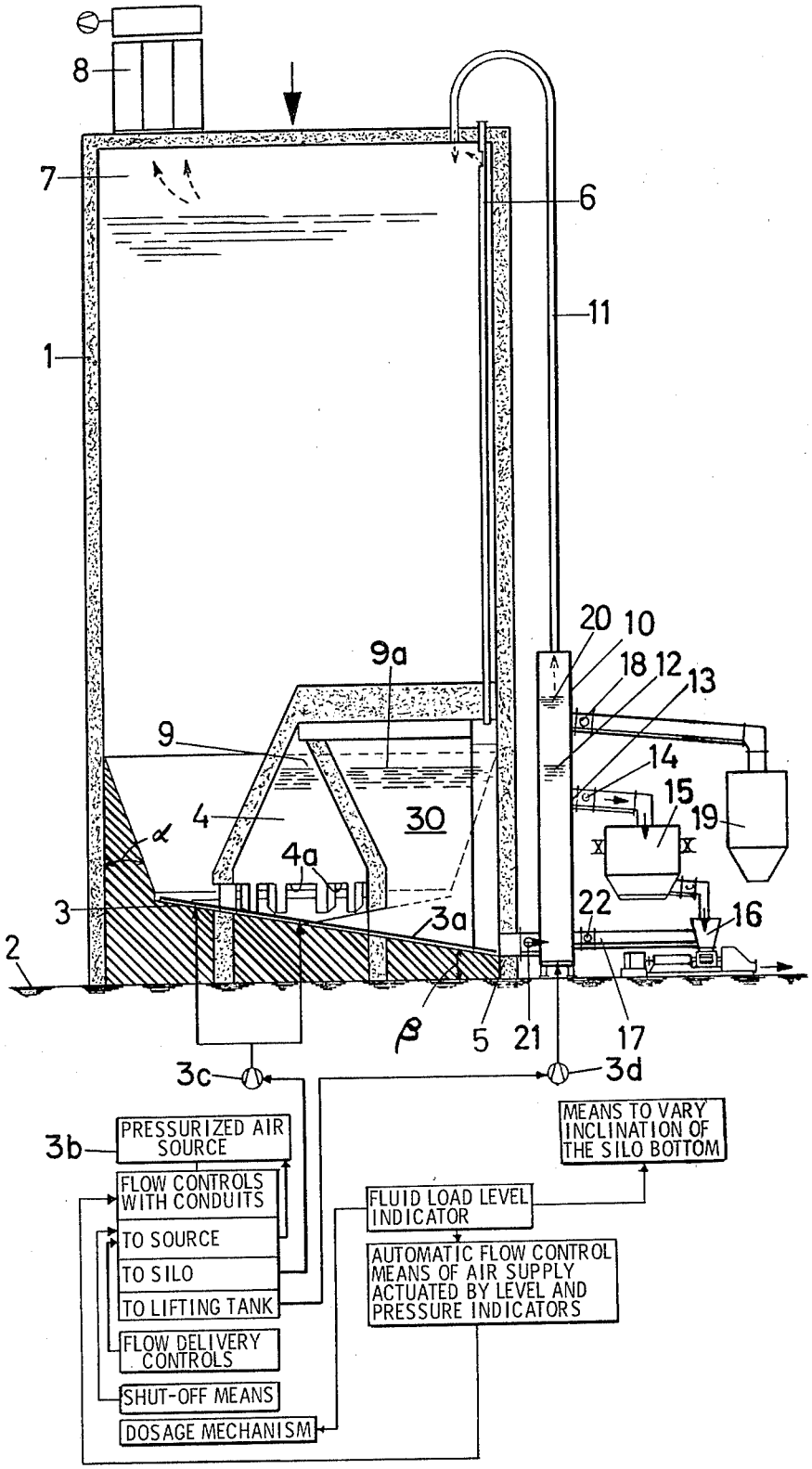
8
7
6
11
1
20
10
18
12
13
9a
9
14
15
19
4
30
α
4a
3
3a
22
16
2
β
5
21
17
3c
3d
3b
PRESSURIZED AIR SOURCE
FLOW CONTROLS WITH CONDUITS
TO SOURCE
TO SILO
TO LIFTING TANK
FLOW DELIVERY CONTROLS
SHUT-OFF MEANS
DOSAGE MECHANISM
FLUID LOAD LEVEL INDICATOR
AUTOMATIC FLOW CONTROL MEANS OF AIR SUPPLY ACTUATED BY LEVEL AND PRESSURE INDICATORS
MEANS TO VARY INCLINATION OF THE SILO BOTTOM

APPARATUS FOR THE LOOSENING AND LIFTING OF AERATED PULVERIZED MATERIAL AT AN INCREASED PRESSURE FROM A SILO

This is a continuation, of application Ser. No. 790,961, filed Apr. 26, 1977 now abandoned.

CROSS REFERENCE TO RELATED APPLICATIONS

Priority of a corresponding patent application filed in the Federal Republic of Germany on May 6, 1976, No. P 26 19 993.9 is claimed under the Convention.

FIELD OF THE INVENTION

The invention refers to an evacuating device in flat-bottomed storage silos for powdered or fine-grained loose materials, with pneumatically operated conveyor troughs. (Class 222/193).

DESCRIPTION OF THE PRIOR ART

U.S. Pat. No. 3,976,232 issued Aug. 24, 1976 to Reinhard Heidebroek, for "Device For Emptying Silos For Bulk Material, Provided With a Flat or Slightly Inclined Bottom" is made of record.

Evacuating devices for storage silos with a mixing chamber arranged in the center of the silo, with ventilated discharge chambers extending from the center of the silo to the wall of the silo have a spout opening per chamber, which is located in the silo wall directly above the silo floor. After the loose material has been aerated above the floor of the main silo, an expanding turbulence enters the central mixing chamber as well as the discharge chamber. The vortex height of this turbulence is a function of the pressure given by the blower in the bottom of the main silo. While the greater mass of the aerating air coming through the silo floor escapes through the vent pipe of the discharge chamber into the upper silo area and to a filter arranged above the silo, and, subsequently, to the outside, a certain amount of the aerating air, together with the fluidized loose material will escape into the adjacent conveyor system whenever the gate valve of the discharge chamber is open.

Thus, the gate valve functions as a throttle and essentially controls the flow of the loose material. Simultaneously, an opened slide valve causes the turbulence in the immediately adjoining discharge chamber to relax. This corresponds to a drop in the pressure within the chamber and causes a decrease in the height of the expansion of the loose material within the chamber. Usually, the aeration pressure and the amount of air used for this aeration are coordinated in such a manner that a minimal expansion height of the turbulence is maintained while the loose material is drawn from the discharge chamber.

The storage capacity of large silos makes it possible to supply several delivery stations with loose material, such as by the arrangement of several discharge ducts on one silo or by additional intermediate storage tanks of smaller capacity.

It was necessary to build such additional storage tanks because in the prior art evacuation systems for silos, the mouth of the discharge spout is located considerably below the necessary elevation for the delivery of the loose material to the delivery station. As a remedy, additional means for vertical transportation and containers had to be provided.

In order to save this expense, additional access to the sides of the silo was provided for additional outflow. By these means it was naturally impossible to obtain uniformly mixed material, because access was gained to a confined area of the main silo only. Whenever the additional tap was located in greater height above the aerated bottom, the connection with the entire aerated bottom, aiding the discharge, was lost.

In order for a silo of the prior art to supply conveyor or production means connected thereto, the feed line of which is located at a certain elevation above ground level, it will either have to be arranged at such an elevation that its discharge spout is located above the feed line of such conveyor or production means, or, should the silo have been erected on undisturbed soil, intermediate conveyor means, for instance bucket conveyors, are required to handle the difference in height. Both of these measures are costly.

Up to the present time, the pressure at the discharge aperture of the silo has not been utilized for the subsequent lifting of the level of the material. A reason for this may be found in the fact that this pressure may fall to very low levels, and even to zero, and thus may not always be available, while, on the other hand, the lifting of the level of the material in connection with its discharge from the silo will be required at all times.

Yet another reason why the discharge pressure of silos has in the past not been utilized for the lifting of the level of the material is that the discharge of the bottom, fluidized layer of material from beneath the masses of compacted material resting above it, and slowing it down, must be enforced with a certain difference between the pressures in the outer region of the floor and the pressure at the discharge aperture. This difference in pressure must have an absolute value which is independent from the counter-pressure at the silo aperture. This leads to the conclusion that the aerating pressure in the silo floor will have to be increased when a counter-pressure in form of a given elevation of the location of the discharge aperture is created. In other words, if a discharge spout is arranged at a certain higher level subsequent to the silo aperture, a corresponding, relatively costly increase in the aeration pressure at the silo floor must be provided. In this connection it has been overlooked that the pressure of the fluidized material at the silo discharge aperture under the influence of the retarding weight of the mass of material resting on it, does not completely fall to the level of atmospheric pressure, because a certain pressure load is needed at the point of the silo discharge aperture in order to support the weight of the higher layers of material.

SUMMARY OF THE INVENTION

It is the purpose of this invention to improve the known silo-evacuation devices with ventilated discharge chambers in such a manner that it becomes possible:

to avoid or to minimize the investments required by the prior art to offset the above mentioned difference in heights;

to make an optimal use of the silo space;

to avoid additional conveyor systems for proper deliveries;

to prevent pulverized loose material from making a short-cut path to the discharge spout; and to subject the areas of the main silo floor in especially close proximity to the evacuation duct to a damping effect equivalent to that of the more remote areas.

This invention utilizes the increased discharge pressure of the fluidized material for the lifting of the level of this material. The material is permitted to rise under the increased pressure in communication with the silo discharge aperture before being relaxed.

Silos with pneumatic discharge methods contain, arranged in the silo floor, means to introduce pressurized gas or air into the layers of the bulk material stored in the bottom area and to finely distribute it throughout these layers. The pressure of the entering gas must be sufficiently high to counteract the contact between the solid particles, compacted by the weight of the upper materials pressing on them which have not yet been fluidized. As a consequence of this step, the fluidized material moving into the direction of the silo discharge opening is under a pressure considerably elevated relative to the atmosphere. Usually, the flow of the discharge is regulated by a flow control mechanism located at the silo discharge aperture, for instance a gate valve, which may throttle the flow to such an extent that only the desired amounts may be discharged from the silo. Because the pressure of the material depends on the filling level of the silo, this pressure is subject to great variations, and it sinks to zero whenever the silo is completely evacuated.

The invention utilizes the experience that a silo, and in particular a storage silo which would be prone to the development of the problems outlined above, rarely ever is completely evacuated. It is quite possible that the discharge pressure sinks to very low levels, whenever the filling level in the silo decreases, but the material needs to be lifted only a short distance to reach the conveyor means which are located nearby. Normally the discharge pressure available when the filling level of the silo has fallen, is sufficient to overcome the normal minor differences in the height of the levels.

The invention recognizes that, considering the relatively minor distances that have to be bridged, a marked increase of the required aeration pressure at the silo floor does not take place. On the contrary, the embodiments as heretofore used always required a lowering of the pressure difference by the flow-control mechanism. This pressure, however, in accordance with this invention, is first being utilized for the lifting of the material and the utilizing flow-control and the throttling resulting therefrom, which take place subsequently and both of which are necessary in connection with this invention.

In order to make use of this method, a means for the lifting of the material is provided, comprising a lifting tank, in communication with the silo discharge opening, which in turn has a discharge opening arranged above the level of the silo opening and has a subsequently arranged flow-control mechanism. The lifting tank may be aerated and may have an auxiliary discharge spout or duct located at its bottom to handle the relatively infrequent situation when the silo will have to be completely evacuated. Instead of this spout or duct, or in addition thereto, this lifting tank may be provided with an auxiliary conveyor means which is to be used only in the case of abnormally low discharge pressures, caused by low filling levels or a complete evacuation of the silo.

The invention is not limited to cases where the silo discharge must handle the full pressure of the entire full silo but is applicable to great advantage even where a relief or discharge chamber precedes the silo discharge opening. Usually, there is increased static pressure within such a relief or discharge chamber caused by the lifted filling level which is sufficient to lift the material after it has passed through the silo discharge aperture, or else the material contained in this chamber is highly aerated, thus creating a certain excess pressure over the atmospheric pressure. Pressures within such discharge or relief chambers are independent of the filling level of the silo and therefore supply a particularly uniform power for the lifting of the material subsequent to the silo discharge.

BRIEF DESCRIPTION OF THE DRAWINGS

In the drawings, drawn substantially to scale, the sole FIGURE of drawings shows a central vertical section through a large capacity silo.

DESCRIPTION OF THE PREFERRED EMBODIMENT

As shown on the Figure, an upright silo 1 with vertical side walls 1*a*, and a silo floor or bottom 3 is supported by the ground. The floor is covered with floor aeration elements 3*a*, for instance pneumatically operated conveyor troughs. Pressurized air source 3*b* with conduits and means 3*c* to control the intensities of air-pressures to the conduits are provided for the aeration of the silo floor and for a pneumatic material conveyor system. In the center of the silo floor is a mixing chamber 4, which has input orifices 4*a* around its circumference, the contents of which are intensively aerated. The mixing chamber 4 is connected with the silo-aperture or discharge opening 5 by means of a path separated from the silo space proper. The mixing chamber also is in conduit connection by means of a ventilation pipe 6 with the upper silo space 7 and an exhaust air filter 8. The flow of the material from the space of the silo is caused by intensive aeration in chamber 4. Thereby, a filling level of the fluidized material is created at the silo discharge aperture 5 and within chamber 4. The path through which the material flows in going from the mixing chamber through the discharge opening 5 is defined by a discharge chamber 30, the interior of which is separated or enclosed from the interior of the silo. The material normally has a filling level 9 in the mixing chamber 4, and a corresponding filling level 9*a* in the discharge chamber.

The aeration elements on the floor of the discharge chamber preferably are inclined towards the wall of the silo. The discharge chamber has discharge opening each preferably equipped with material delivery control means in the form of shut-off and dosage mechanisms located outside the silo.

The lower part of the silo wall preferably has a funnel type inclination at an angle of about $\alpha=25°$ to 30° from vertical and the silo floor has an inclination toward the lower delivery station of about $\beta=8°$ to 10° from horizontal, preferably with means to vary these inclinations manually depending on the fluid material to be conveyed.

It is within the scope of the invention to vary the angle of the inclination of the floor of the discharge chamber aeration elements in consideration of the level of the silo load, the specific weight of the fluid material conveyed, the pneumatic forces applied and the diameters of the upper and lower outlet orifices, anyone or each of which in turn also being controllable, relative to the others to provide an optimum material delivery. When the level of the material sinks below an operable height, auxiliary blower-control means are provided to actuate and direct an auxiliary blower into the conduits thereby increasing the pneumatic aeration in the area of the silo floor outside the mixing and discharge chambers, so that the level of the fluidized loose material within the discharge chamber rises again.

A lifting tank 10 connected to the silo discharge aperture 5, is ventilated into the upper silo space 7 by means of a pipe 11. In the tank, a filling level 12 is created which is comparable to the filling level 9 of the mixing chamber 4, and filling level 9a of the discharge chamber 30. A discharge spout 13, with a flow-control mechanism 14 of the lifting tank is located—for safety reasons—at a distance somewhat below the level 12. An intermediary pressure compensating container 15 is provided which serves, for instance, to regulate the uniformity of the discharge. The material flows from the intermediary container toward a dust pump 16 of the pneumatic conveyor system. If, in exceptional circumstances, (for instance whenever the silo is to be completely evacuated) the pressure becomes insufficient to raise the level of the material to the discharge spout 13, the intermediary container 15 is circumvented and the material is taken to the dust pump 16 by way of an auxiliary duct 17.

The floor of the lifting tank 10 is aerated. Means are provided to adjust the intensity of this aeration to control the density of the material-gas-mixture within the lifting tank 10. Whenever the filling level at the silo discharge aperture 5 becomes undesirably low, increased aeration within the lifting is caused to decrease the density of the material to such an extent that it can still reach the discharge spout 13. The means for such an intensified aeration may be employed as an auxiliary conveyor means in the rare case that the over-pressure at the silo discharge aperture should become insufficient.

The level 20 of the material inside the lifting tank 10 is shown elevated over the filling level 9 within chamber 4. This elevated level within the lifting tank is achieved by additional aeration, furnished by an auxiliary blower underneath the lifting tank. It is possible to achieve a considerable rise in the elevation using a minimum of additional aeration. The auxiliary duct 17 leading to the dust pump has a closing mechanism 22 and a dosage mechanism 21 which is located between the lateral silo discharge aperture 5 and the rising tank 10. The intermediary container 19 preceded by the flow control mechanism 18, and the connecting air supplying spout provide additional means to withdraw the material from the lifting tank 10 to a higher elevation.

The positioning of the discharge spout above the floor level of the discharge chamber 30 is supported by the following reasoning.

In silos with centrally located mixing chambers and discharge openings arranged around the lateral sides there is the danger that the pulverized loose material coming from the main silo will enter the chamber through these openings in a short-cut path through to the discharge spout at one side, which is in level with the silo floor. Silos with centrally located mixing chambers do not only provide a highly efficient use of the silo space but also serve to buffer chemical and/or physical variances. In order to make optimal use of this function, the present invention avoids a short-cut path between the centrally located mixing chamber 4, and the lower, laterally arranged discharge opening. This is achieved by providing the upper spout in elevated position above the floor of the discharge chamber 30. For this purpose it is possible advantageously to discharge materials by way of the upper spout only, and, for instance, by means of a throttled or completely shut off aeration of the floor of the discharge chamber 30, to move the pulverized material from the centrally located mixing chamber 4 by using the overflow. Thus, by the present invention the path of the turbulence through the already provided ventilation aperture of the mixing chamber 4 is caused to be longer. Thus, a labyrinth system is created between the mixing chamber and the discharge chamber of the silo. When using the aforementioned procedure, the material to be discharged in its turbulent phase is carried upward vertically from the silo floor instead of in the direction parallel to it, in order to come through the upper lateral discharge spout. Inasmuch as chamber 30 holds a multiple of the usable contents of mixing chamber 4, this labyrinthal path of the turbulence through chamber 30 excludes a possible short-cut path in the direction of the discharge spout of the silo. The spout located at the lower level takes over to function whenever the entire silo is to be evacuated completely. In addition it serves the possible removal of settled foreign matter from the slightly inclined floor.

Further advantages of the utilization of the upper discharge spout are in the reduced pressure on the connected dosage mechanism. The discharge velocities are reduced, and the dosage of the flow of the loose material becomes more effectively controllable.

The labyrinth effect between the mixing chamber and the discharge chamber is created whenever the aeration of the discharge chamber is turned off, and the pulverized material travels along the path from the mixing chamber overflow in the direction of the upper discharge spout.

Thus, in accordance with the invention, it is possible to feed the material to the dust pump 16 to a sufficiently elevated level without having to resort to expensive substructures for the silo and without separate conveyor means between the silo and the dust pump 16. This is supported by calculations and experiments.

What is claimed is:

1. A silo for storing, fluidizing and discharging particulate material, comprising:

an upright silo having a side wall and a bottom, said side wall having a discharge opening therethrough at the bottom;

a discharge chamber in the silo on the silo bottom, at one side of the silo between the silo contents and the discharge opening, serving to separate the discharge opening from the silo contents and being in communication with the discharge opening and with the silo interior, said discharge chamber defining an enclosed flow passage from the silo interior to the discharge opening;

an upright lifting tank adjacent the silo at one side thereof and having a top and a bottom and being in communication at its bottom with the discharge opening, the bottom of the lifting tank being substantially at the level of the silo bottom, and said lifting tank having an elevated spout above the level of said discharge opening; and aeration means connected with the silo bottom in communication with the silo interior and the discharge chamber interior, to fluidize the silo contents at least at the bottom of the silo and cause them to flow into the discharge chamber, said discharge chamber enabling a substantially constant positive pressure to be attained at the discharge opening, dependent at least partially upon the level of material in the discharge chamber and being substantially independent of the level of material and pressure in the silo interior, the positive pressure which is attained at the discharge opening by said aeration means enabling the material to be lifted in the lifting tank to and through the discharge spout by only the pressure existing in the discharge chamber;

wherein a second elevated discharge opening is in the lifting tank above the discharge spout, for discharging the material at an even higher elevation, and auxiliary blower means communicates with the bottom of the lifting tank to lift material to the second discharge opening.

2. A silo for storing, fluidizing and discharging particulate material, comprising:

an upright silo having a side wall and a bottom, said side wall having a discharge opening therethrough at the bottom;

a discharge chamber in the silo on the silo bottom, at one side of the silo between the silo contents and the discharge opening, serving to separate the discharge opening from the silo contents and being in communication with the discharge opening and with the silo interior, said discharge chamber defining an enclosed flow passage from the silo interior to the discharge opening;

an upright lifting tank adjacent the silo at one side thereof and having a top and a bottom and being in communication at its bottom with the discharge opening, the bottom of the lifting tank being substantially at the level of the silo bottom, and said lifting tank having an elevated spout above the level of said discharge opening; and aeration means connected with the silo bottom in communication with the silo interior and the discharge chamber interior, to fluidize the silo contents at least at the bottom of the silo and cause them to flow into the discharge chamber, said discharge chamber enabling a substantially constant positive pressure to be attained at the discharge opening, dependent at least partially upon the level of material in the discharge chamber and being substantially independent of the level of material and pressure in the silo interior, the positive pressure which is attained at the discharge opening by said aeration means enabling the material to be lifted in the lifting tank to and through the discharge spout by only the pressure existing in the discharge chamber, wherein a central mixing chamber is in the silo on the silo bottom, said mixing chamber having a plurality of openings at the bottom thereof communicating the interior of the silo, and having at least one opening communicating the mixing chamber with the discharge chamber, for flow of material from the silo, through the mixing chamber and into the discharge chamber, wherein an opening between the top of the mixing chamber and the top of the discharge chamber establishes communication therebetween to prevent entrapment of air in the top of the mixing chamber and also to provide an overflow from the mixing chamber to the discharge chamber, and a vent means communicating the discharge chamber with the interior of the silo;

wherein the silo bottom is inclined toward the discharge opening, the aeration means includes aeration elements in the silo bottom, inclined toward the discharge opening, a second elevated discharge opening is in the lifting tank above the discharge spout, for discharging the material at an even higher elevation, and auxiliary blower means communicates with the bottom of the lifting tank to lift material to the second discharge opening.

3. A silo as claimed in claim 2, wherein a conduit is connected with each of the elevated discharge openings from the lifting tank and flow control means is in each of the conduits for obtaining a relatively constant flow therethrough.

* * * * *